US008875345B2

(12) United States Patent
Miglioranzo

(10) Patent No.: US 8,875,345 B2
(45) Date of Patent: Nov. 4, 2014

(54) HINGE

(75) Inventor: Ivano Miglioranzo, Valeggio sul Mincio (IT)

(73) Assignee: OL.MI S.R.L., Castelnuovo del Garda (VR) (IT)

( * ) Notice: Subject to any disclaimer, the term of this patent is extended or adjusted under 35 U.S.C. 154(b) by 0 days.

(21) Appl. No.: 14/115,331

(22) PCT Filed: Mar. 2, 2012

(86) PCT No.: PCT/IB2012/051006

§ 371 (c)(1),
(2), (4) Date: Nov. 1, 2013

(87) PCT Pub. No.: WO2012/150507

PCT Pub. Date: Nov. 8, 2012

(65) Prior Publication Data

US 2014/0053369 A1 Feb. 27, 2014

(30) Foreign Application Priority Data

May 4, 2011 (WO) ..... PCT/IB2011/051967

(51) Int. Cl.

| | |
|---|---|
| ***E05F 3/20*** | (2006.01) |
| ***E05F 3/00*** | (2006.01) |
| ***E05F 3/12*** | (2006.01) |
| ***E05F 3/10*** | (2006.01) |

(52) U.S. Cl.

CPC ... *E05F 3/20* (2013.01); *E05F 3/12* (2013.01); *E05Y 2201/264* (2013.01); *E05Y 2201/256* (2013.01); *E05Y 2201/21* (2013.01); *E05F 3/104* (2013.01)

USPC ..... 16/54

(58) Field of Classification Search

CPC ..... E05F 3/20; E05F 3/12; E05F 1/1215; E05F 1/1253; E05Y 2201/416

USPC ..... 16/50, 54, 280, 281, 298, 299, 303, 16/289, 306

See application file for complete search history.

(56) References Cited

U.S. PATENT DOCUMENTS 1,927,778 A * 9/1933 Hirakawa ..... 16/54
2,018,564 A * 10/1935 Milly ..... 16/374

(Continued)

FOREIGN PATENT DOCUMENTS

CH 355373 6/1961
CH 355373 A * 6/1961

(Continued)

*Primary Examiner* — Victor Batson
*Assistant Examiner* — Jason W San
(74) *Attorney, Agent, or Firm* — Themis Law

(57) ABSTRACT

A hinge includes a hinge body having an operating chamber defining a first longitudinal axis; a pivot rotatably coupled to the hinge body to rotate a closing element around a second longitudinal axis between an open and a closed position; a plunger member having a substantially cylindrical body housed in the operating chamber for the separation thereof into a first and a second variable volume receptacles fluidically connected each other; a working fluid within the operating chamber to hydraulically damp the action of the plunger member; valve means to selectively control the flow of the working fluid between the first and the second receptacle; a shaft for operatively coupling the plunger member and the pivot. The cylindrical body and the shaft are mutually fastened by a fastening element. The shaft includes a first enlarged portion. The cylindrical body is put into fluidic communication the first and second receptacles.

22 Claims, 7 Drawing Sheets

(56) References Cited

U.S. PATENT DOCUMENTS

| | | | | | |
|---|---|---|---|---|---|
| 2,164,358 | A * | 7/1939 | Stannard | 16/54 | |
| 2,469,447 | A * | 5/1949 | Swanson | 16/54 | |
| 2,484,764 | A * | 10/1949 | Swanson | 16/54 | |
| 2,485,937 | A * | 10/1949 | Swanson | 16/54 | |
| 2,490,258 | A * | 12/1949 | Diebel | 16/54 | |
| 2,493,115 | A * | 1/1950 | Diebel | 16/300 | |
| 2,493,117 | A * | 1/1950 | Diebel | 16/82 | |
| 2,538,678 | A * | 1/1951 | Foltis | 16/68 | |
| 2,538,679 | A * | 1/1951 | Foltis | 16/68 | |
| 4,425,939 | A * | 1/1984 | Marinoni et al. | 137/599.18 | |
| 5,383,253 | A * | 1/1995 | Lin | 16/54 | |
| 5,832,561 | A * | 11/1998 | Bienek | 16/53 | |
| 5,855,040 | A * | 1/1999 | Lin | 16/50 | |
| 6,205,619 | B1 * | 3/2001 | Jang | 16/352 | |
| 6,464,052 | B1 * | 10/2002 | Hsiao | 188/290 | |
| 6,658,694 | B2 * | 12/2003 | Wang | 16/50 | |
| 6,829,807 | B2 * | 12/2004 | Kim | 16/322 | |
| 7,334,292 | B2 * | 2/2008 | Anzai | 16/54 | |
| 7,509,710 | B1 * | 3/2009 | Lin et al. | 16/337 | |
| 7,743,465 | B2 * | 6/2010 | Lin | 16/303 | |
| 7,784,153 | B2 * | 8/2010 | Lin | 16/303 | |
| 7,900,319 | B2 * | 3/2011 | Bacchetti | 16/252 | |
| 7,966,693 | B2 * | 6/2011 | Choi et al. | 16/54 | |
| 8,104,142 | B2 * | 1/2012 | Lowry et al. | 16/307 | |
| 8,370,994 | B2 * | 2/2013 | Duan et al. | 16/330 | |
| 8,516,657 | B2 * | 8/2013 | Yoshida | 16/50 | |
| 2009/0241289 | A1 * | 10/2009 | Choi et al. | 16/275 | |
| 2011/0072618 | A1 * | 3/2011 | Chen | 16/303 | |
| 2011/0302743 | A1 * | 12/2011 | Kim et al. | 16/248 | |
| 2013/0081228 | A1 * | 4/2013 | Janak | 16/250 | |
| 2014/0033476 | A1 * | 2/2014 | Bacchetti | 16/52 | |
| 2014/0053369 | A1 * | 2/2014 | Miglioranzo | 16/54 | |
| 2014/0075718 | A1 * | 3/2014 | Bacchetti | 16/54 | |

FOREIGN PATENT DOCUMENTS

| | | | | |
|---|---|---|---|---|
| DE | 10228510 | A1 * | 1/2004 | |
| DE | 102006019529 | A1 * | 11/2007 | |
| DE | 102006019548 | A1 * | 11/2007 | |
| DE | 202011000307 | U1 * | 6/2011 | |
| EP | 1900896 | | 3/2008 | |
| EP | 2241708 | | 10/2010 | |
| EP | 2397635 | A1 * | 12/2011 | |
| EP | 2559365 | A2 * | 2/2013 | |
| GB | 2145769 | | 4/1985 | |
| JP | 52052452 | A * | 4/1977 | E05F 3/08 |
| WO | WO 9605397 | A1 * | 2/1996 | |
| WO | WO 2004003412 | A1 * | 1/2004 | |
| WO | WO 2006018186 | A1 * | 2/2006 | |
| WO | 2006025663 | | 3/2006 | |
| WO | WO 2009044910 | A1 * | 4/2009 | |
| WO | WO 2011016000 | A1 * | 2/2011 | |
| WO | WO 2011009557 | A3 * | 3/2011 | |
| WO | WO 2012137042 | A1 * | 10/2012 | |
| WO | WO 2012143812 | A3 * | 9/2013 | |

* cited by examiner

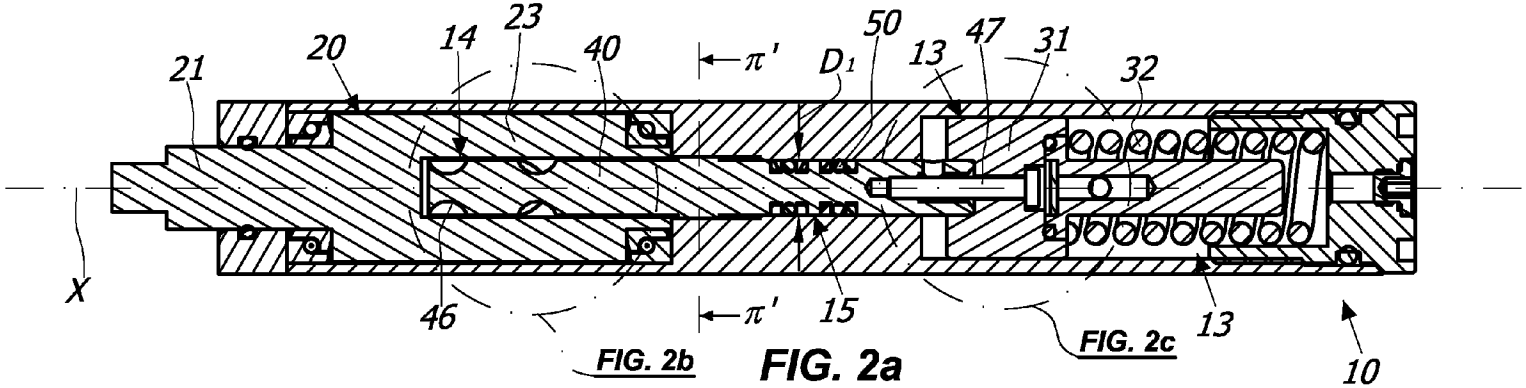
FIG. 2a
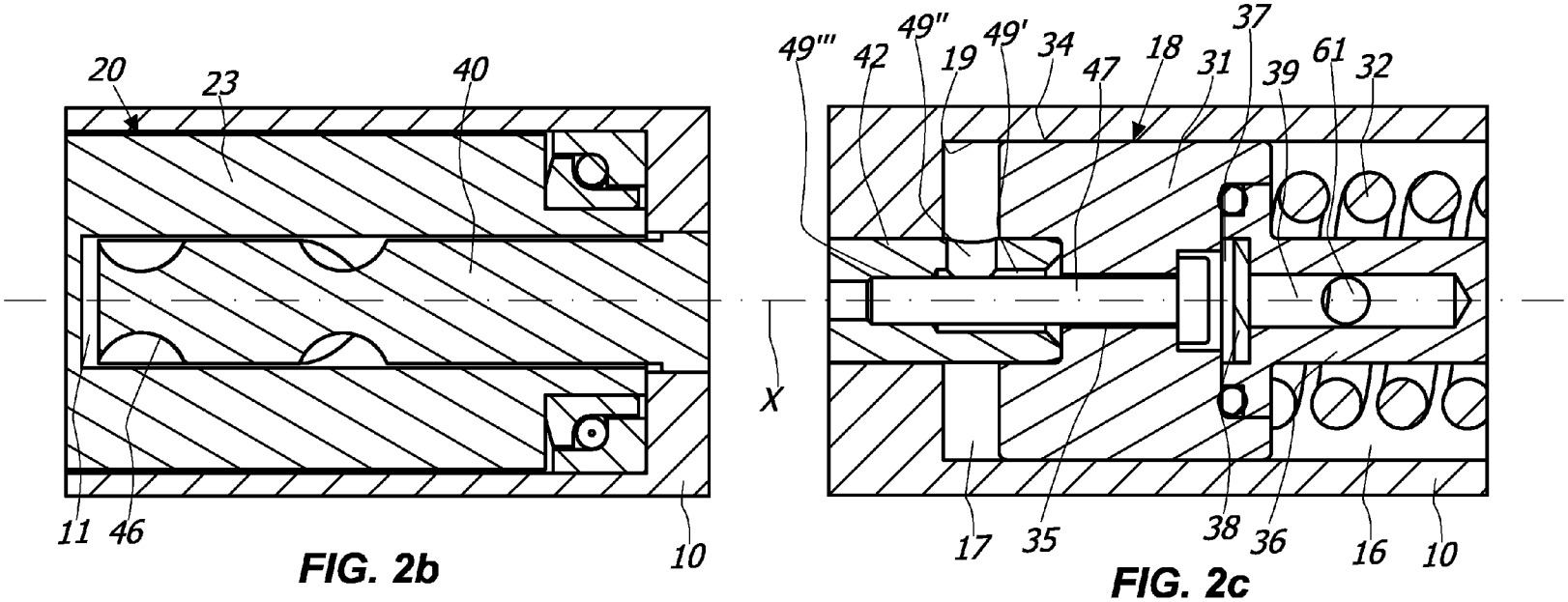
FIG. 2c
FIG. 2b

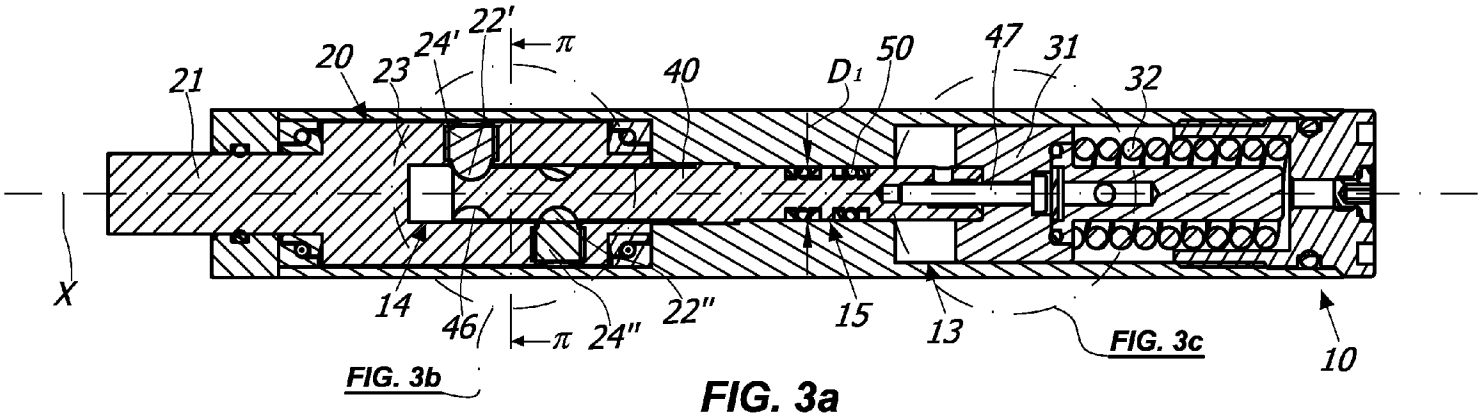
FIG. 3a
FIG. 3c
FIG. 3b
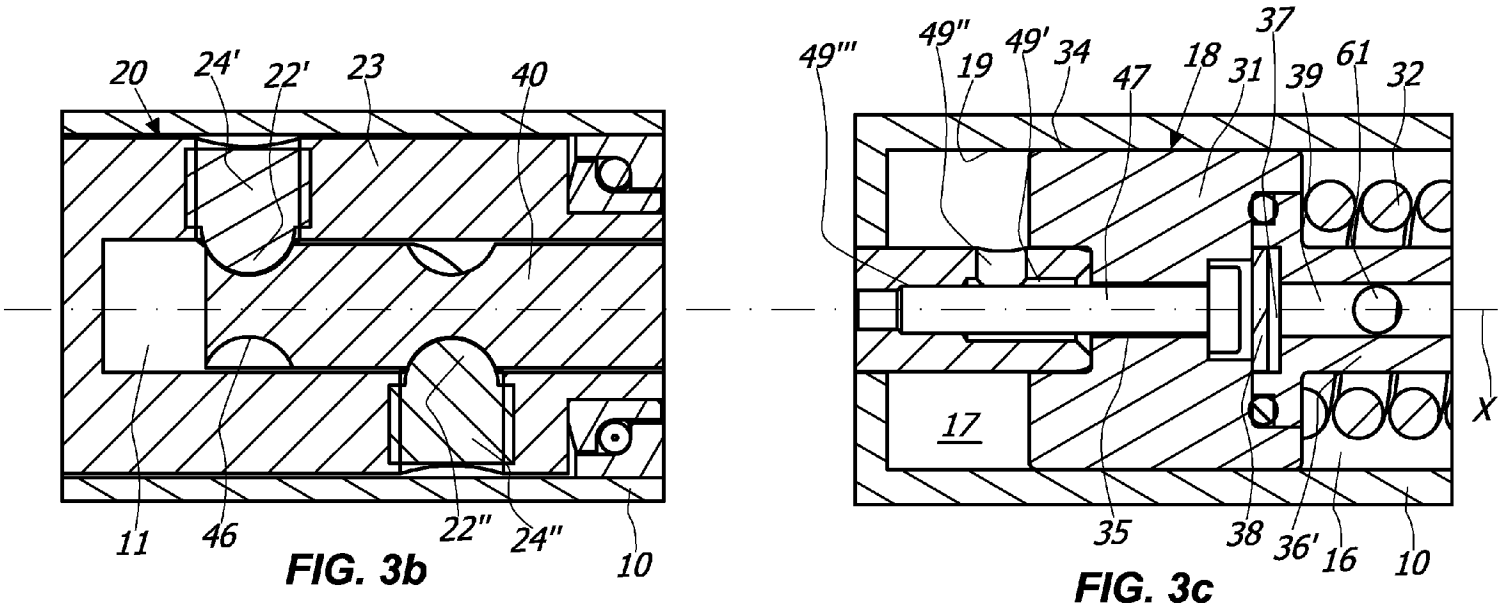
FIG. 3c
FIG. 3b 10
32
31
47
50
51
40
24'
23
21
22'
46
22"
24"
X 10
40
24"
22"
24'
23
46
22'
X

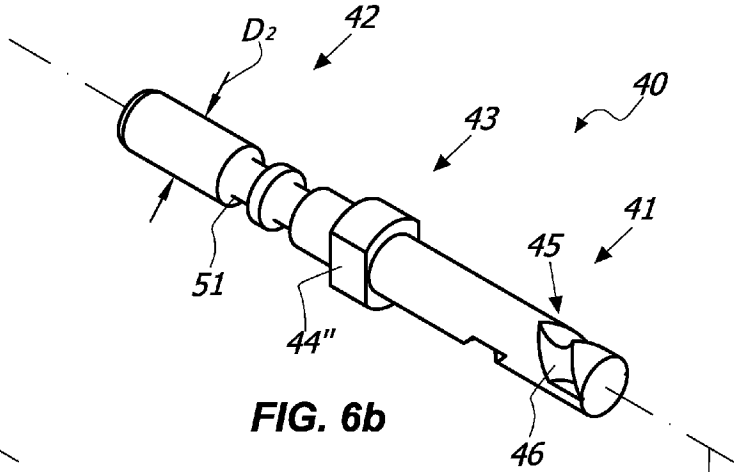
FIG. 6a
FIG. 6b
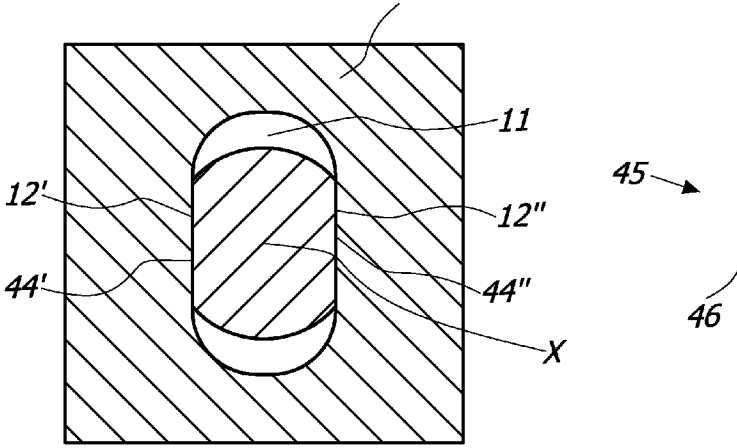
FIG. 7
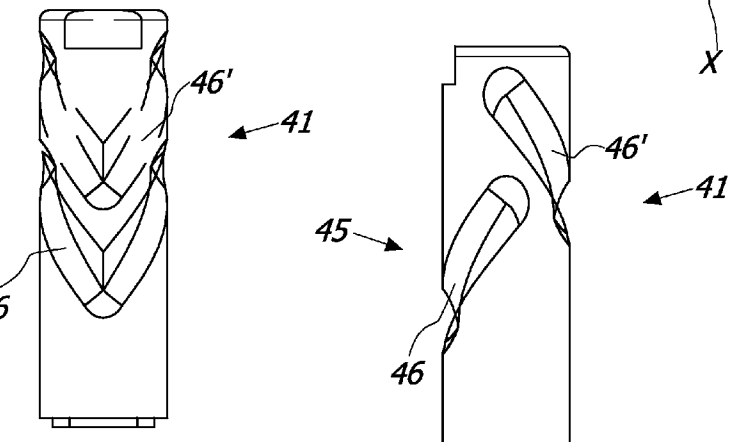
FIG. 8a
FIG. 8b

HINGE

FIELD OF INVENTION

The present invention is generally applicable in the technical field of the closing or braking hinges, and particularly relates to a hinge.

BACKGROUND OF THE INVENTION

Hinges are known which comprise a hinge body anchorable to a stationary support structure, such as a wall or the like, and a pivot anchorable to a door, a shutter or the like rotatably coupled thereto for rotating around an axis between an open position and a closed position.

The pivot generally includes cam means, whereas the hinge body comprises a plunger member slidably movable upon interacting with the cam means for automatically return the door from the open position to the closed one.

Moreover, a working fluid is provided acting on the plunger member to hydraulically damp the action thereof.

Examples of these hinges are known from the International Applications WO2007125524 and WO2011016000. In both these hinges the plunger element moves along a direction that is substantially perpendicular to the rotation axis of the door.

Examples of these hinges are known from documents U.S. Pat. No. 5,855,040, U.S.2006230573, WO2006025663, EP2241708, U.S. Pat. No. 4,259,763, EP1900896, U.S. Pat. No. 491,898 and U.S. Pat. No. 2,230,661. In both these hinges the plunger element moves along a direction that is substantially parallel to the rotation axis of the door.

These known hinges can be improved with respect to bulkiness, costs and/or of manufacturing and/or assembly.

SUMMARY OF THE INVENTION

A main object of the present invention is to overcome, at least in part, the above mentioned drawbacks, by providing a hinge having characteristics of high functionality and constructional simplicity.

Another object of the invention is to provide a hinge having a moderate bulking.

Another object of the invention is to provide a hinge that is very low cost.

Another object of the invention is to provide a hinge which ensures the automatic closing of the door from the open position.

Another object of the invention is to provide a hinge which ensures the controlled movement of the door on which it is mounted, upon the opening as well as upon closing of the door.

Another object of the invention is to provide a hinge simple and quick to be assembled.

These and other objects, as better explained hereafter, are fulfilled by a hinge according to which is herein disclosed, claimed and/or shown.

The hinge according to the invention may be particularly suitable for mutually coupling a closing element, such as a door, a shutter or the like, and a stationary support structure, such as a frame, a wall, a floor or the like.

The hinge according to the invention may be a closing hinge, i.e. a hinge allowing the automatic closure of the closing element from the open position, or a hydraulic brake hinge, i.e. a hinge allowing the damping of the opening and/or closing action of the closing element.

In the former case, the hinge must include counteracting elastic means, such as a torsion or compression spring, while in the latter case the hinge may or may not include elastic means.

The hinge according to the invention may include a hinge body anchorable to one between the stationary support structure and the closing element and a pivot anchorable to the other between the stationary support structure and the closing element.

The hinge body may comprise at least one operating chamber defining a first longitudinal axis, while the pivot and the hinge body may be rotatably coupled to each other in such a manner to rotate the door around a second longitudinal axis between an open position and a closed position.

The first and the second longitudinal axis may be either substantially parallel or perpendicular without departing from the scope of the invention as defined by the claims.

The hinge may include a plunger member slidably movable in the operating chamber along the first axis between a compressed end position and an extended end position. Advantageously, a working fluid, such as oil, may be provided within the operating chamber to hydraulically damp the action of the plunger member.

The plunger member may comprise a substantially cylindrical body housed in the operating chamber for the separation thereof into at least one first and second variable volume receptacles fluidically connected to each other. In a preferred but not exclusive embodiment of the invention, the receptacles may be reciprocally adjacent.

Suitably, valve means may be provided which include a fluid control member, such as a butterfly valve, movable preferably along the first axis into a respective valve seat unitary with the cylindrical body to selectively allowing the flow of the working fluid between the first receptacle and the second receptacle upon one between the opening and the closing of the closing element and to avoid the backflow thereof upon the other between the opening and the closing of the closing element.

In a preferred, non-exclusive embodiment of the invention, the hinge may include a shaft within the operating chamber defining the first axis for operatively coupling the plunger member and the pivot. The shaft and the pivot may be rotatably coupled to each other in such a manner that the rotation of the door around the second axis, i.e. the rotation around the latter of the hinge body or the pivot, corresponds to the sliding of the plunger member the first axis and vice-versa.

The cylindrical body of the plunger member and the shaft may mutually fastened, preferably in a removable manner, by a fastening element inserted into a first hole passing through the cylindrical body to engage a second blind hole faced to the first passing-through hole made on an end of the shaft.

Advantageously, the second blind hole may include a first enlarged portion and a second engaging portion for engaging the fastening element, the cylindrical body comprising a third passing through hole to put into fluidic communication the first receptacle and the second receptacle via the valve seat and the first enlarged portion.

Preferably, the first passing-through hole of the cylindrical body, the second blind hole of the shaft and the valve seat may lay on a third axis which may be parallel or coincident to the first axis.

The third passing through hole may have any shape and/or inclination with respect to the first one. Preferably, the third passing through hole may coaxially encompasses the first passing-though hole. In other words, the third passing-though hole may define an axis parallel to the third axis.

In a preferred, non-exclusive embodiment of the invention the fluid control member may be in a removable coupling relationship with the cylindrical body that the selective access of a user to the fastening element for the mutual coupling/decoupling thereof to the shaft is selectively allowed when the cylindrical body and the fluid control member are mutually decoupled and is unallowed when the latter is in the operative position.

Suitably, the operating chamber may comprise a first compartment for housing the plunger member and the working fluid and a second compartment for housing the pivot. Separation means may be provided to fluidically separate the first compartment and the second compartment, the cylindrical body being located in the first compartment for separating thereof into the at least one first and second variable volume receptacles.

Advantageously, one between the shaft and the pivot may comprise a cam element, the other between the shaft and the pivot may comprise at least one follower member.

As used herein, the term "cam element" and derivatives thereof is intended to indicate at least one mechanical member of any shape, which is designed to turn a circular motion into a rectilinear motion and vice-versa.

As used herein, the term "follower member" and derivatives thereof is intended to indicate at least one mechanical member of any shape, which is designed to cooperate with the cam element, as defined above.

The dependent claims define preferred but non-exclusive embodiments of the invention.

BRIEF DESCRIPTION OF THE DRAWINGS

Further features and advantages of the invention will appear more evident upon reading the detailed description of some preferred, non-exclusive embodiments of a hinge according to the invention, which is described as non-limiting examples with the help of the annexed drawings, in which:

FIG. 2*a* is an axially sectioned view of the embodiment of the hinge 1 of FIG. 1 in the closed door position, with in FIGS. 2*b* and 2*c* some enlarged particulars;

FIG. 3*a* is an axially sectioned view of the embodiment of the hinge 1 of FIG. 1 in the open door position, with in FIGS. 3*b* and 3*c* some enlarged particulars;

FIG. 6*a* is an axonometric view of the shaft 40, with in FIG. 6*b* an axonometric view of the same shaft 40 rotated of 180° around the axis X;

FIG. 7 is a sectioned view of the hinge 1 taken along a plane π'-π';

FIGS. 8*a* and 8*b* are front views of the first portion 41 of the shaft 40, showing the V-shaped helical cam element 45;

DETAILED DESCRIPTION OF SOME PREFERRED EMBODIMENTS

Referring to the above mentioned figures, the two embodiments of the hinge 1 shown as an illustrative but non-limiting example of the invention are particularly suitable to automatically close all kind of closing elements, such as doors, shutters, windows, window frames or like elements, which can preferably be made of metallic material, wood, glass, composite materials or the like.

On the other hand, the hinge according to the invention can also be configured as a hydraulic braking hinge.

Figures 9, 10:
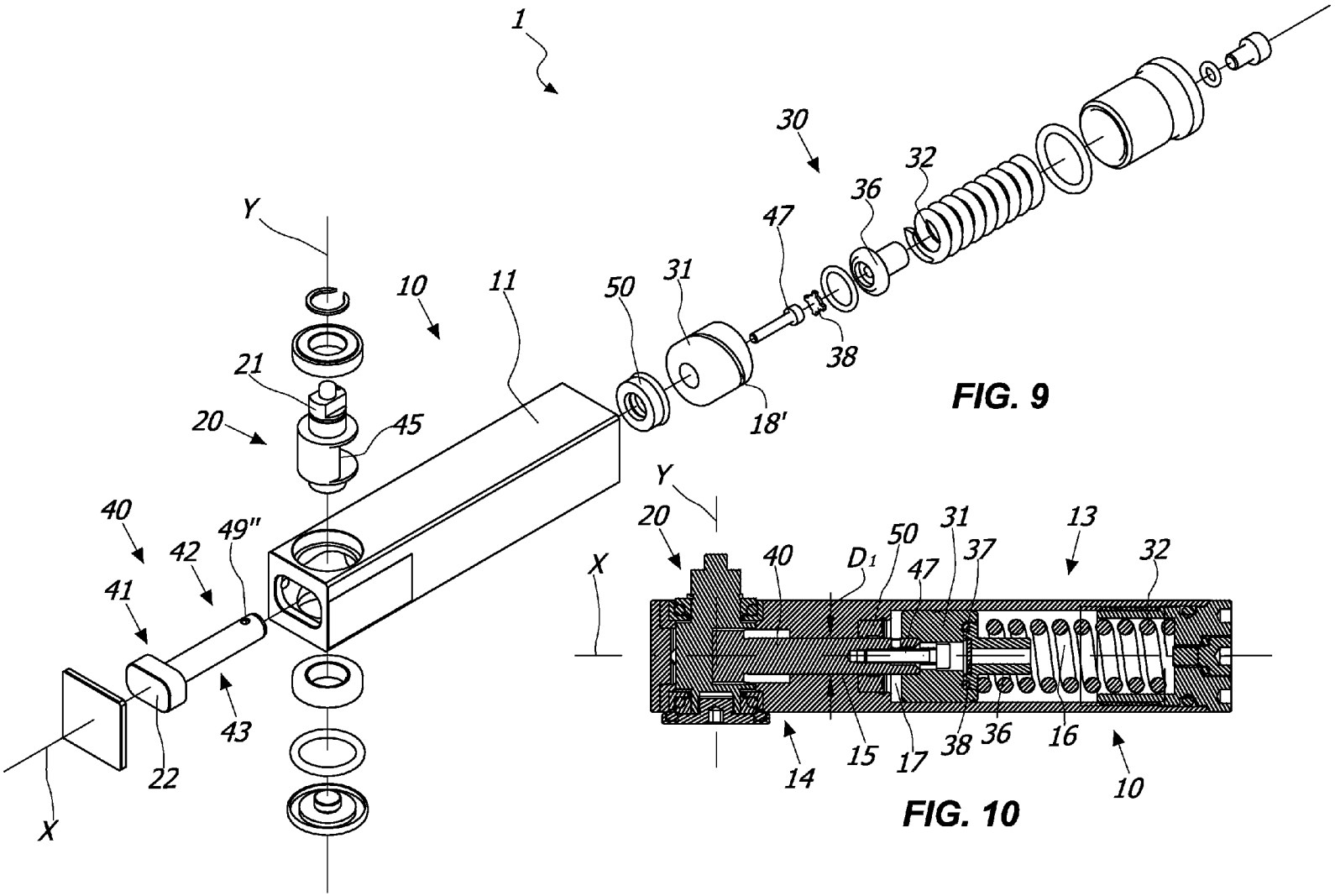
FIG. 9 is an exploded view of a second embodiment of the hinge 1 according to the invention.
FIG. 10 is an axially sectioned view of the embodiment of the hinge 1 of FIG. 9 in the closed door position.

The following description discloses two embodiments of the invention, a first one according to FIGS. 1 to 8*b* and a second one according to FIGS. 9 and 10. Unless otherwise indicated, the features common to the two embodiments are indicated with a single number.

The hinge 1 may comprise a hinge body 10 anchorable to a stationary support structure, such as a wall or the like, and a pivot 20 anchorable to a door, a shutter or the like. On the other hand, the pivot 20 may be anchored to the support structure and the hinge body 10 may be anchored to the closing element without departing from the scope of the invention as defined by the claims.

To this end, both the hinge body 10 and the pivot 20 may comprise suitable anchoring means, which may be of any kind.

For example, the hinge body 10 may comprise one or more fastening members, such as one or more screws and/or bolts, to anchor it to a wall or the frame of a door. On the other hand, the hinge body may have an elongated form to be embedded or otherwise inserted into a wall or a door frame, in such a manner to be partly or completely hidden to the user's sight.

The pivot 20 may comprise an anchoring portion 21 designed to cooperate with a countershaped part of a door.

For the sake of clarity, both the stationary support structure and the closing element, which are per se well known in the art, have not been shown in the drawings.

Advantageously, the hinge body 10 and the pivot 20 may be reciprocally coupled to rotate around a first longitudinal axis Y between an open door position, shown e.g. in FIG. 3*a*, and a closed position, shown e.g. in FIG. 2*a*.

The hinge body 10 may comprise an operating chamber 11, which defines a second longitudinal axis X, along which a plunger member 30 slidably moves between a compressed end position, corresponding to the open door position of FIG. 3*a*, and an extended end position, corresponding to the closed door position of FIG. 2*a*.

In the first embodiment of the invention shown in FIGS. 1 to 8*a*, the first and second longitudinal axes X and Y are reciprocally parallel and coincide, indicated X≡Y, while in the second embodiment of the invention shown in FIGS. 9 and 10, the first and second longitudinal axes X and Y are reciprocally perpendicular.

Suitably, the plunger member 30 may comprise a substantially cylindrical body 31, that is housed in the operating chamber 11, and counteracting elastic means, for example a spring 32, acting thereon to move it between the compressed and extended end positions.

The pivot 20 and the plunger member 30 may be reciprocally coupled in such a manner that the rotating movement of the former about the axis Y corresponds to the sliding movement of the latter along the axis X, and vice versa.

In fact, upon the opening of the door, i.e. upon the rotating of the pivot 20 along the axis Y, the plunger member 30 slides along the axis X by passing from the extended end position of FIG. 2*a* to the compressed end position of FIG. 3*a*.

In this situation, the plunger member 30 acts on the pivot 20 to automatically return the door from the open position to the closed position. As it is apparent, this is due to the action of the spring 32 that elastically returns from the compressed end position to the extended end position.

Suitably, a shaft 40 may be inserted into the operating chamber 11 for operatively coupling the plunger member 30 and the pivot 20. The shaft 40 may define the axis X, and may have a first end portion 41 operatively coupled to the pivot 20 and a second opposite end portion 42 operatively coupled to the plunger member 30.

In order to ensure the operative coupling between the pivot 20 and the shaft 40, one of the latter may include a cam element 45, the other comprising at least one follower member 22'.

Advantageously, as particularly shown in FIG. 7, the shaft 40 may have a central portion 43 having two opposite flat faces 44', 44" designed to cooperate with corresponding flat surfaces 12', 12" of the operating chamber 11 for rotatably blocking the shaft 40. In this manner, rotation of the latter around the axis X is avoided during the sliding of the plunger member 30 between the compressed and extended end positions.

In the first embodiment of the invention shown in FIGS. 1 to 8*a*, the first portion 41 of the shaft 40 may include a helical cam element 45 operatively engaged with at least one follower member belonging to the pivot 20, such as one couple of followers 22', 22" placed on opposite sides of the pivot 20. In this manner, the rotating movement of the pivot 20 around the axis X═Y will correspond to the axial movement of the shaft 40 and the plunger member 30 along the same axis X═Y.

Conveniently, for maximum smoothness in the reciprocal movement, the helical cam element 45 may comprise a couple of V-shaped grooves 46, 46' having semispherical section, whereas the followers 22', 22" may have a counter-shaped semispherical shape. Moreover, the semispherical followers 22', 22" may be staggered with respect to a medium radial plane π laying therebetween.

In a preferred, non-exclusive embodiment of the invention, the pivot 20 may include a cylindrical wall 23 designed to encompass the helical cam element 45 of the shaft 40. Thanks to this configuration, the bulkiness of the hinge 1 is minimized, because the shaft 40 and the pivot 20 are telescopically coupled.

Suitably, in order to greatly simplify the assembling of the hinge 1, the semispherical followers 22', 22" may be mounted on respective set screws 24', 24" passing through the cylindrical wall 23.

In the second embodiment of the invention shown in FIGS. 9 and 10, the pivot 20 may include a cam element 45 operatively engaged with the follower member 22 belonging to the first portion 41 of the shaft 40. Both the cam element and the follower member may be configured according to the teachings of the documents WO2007125524 and/or WO2011016000, which can be referred to for proper consultation.

In this manner, the rotating movement of the pivot 20 around the axis Y will correspond to the axial movement of the shaft 40 and the plunger member 30 along the axis X.

Apparently, the two embodiments of the hinge 1 according to the invention shown in the annexed figures differ only in the front mechanical actuating part, while the hydraulic rear part is identical for both embodiments.

The second portion 42 of the shaft 40 may be removably mutually connected to the plunger element 30 by a fastening element, such as a bolt 47, passing through the latter.

Figure 1:
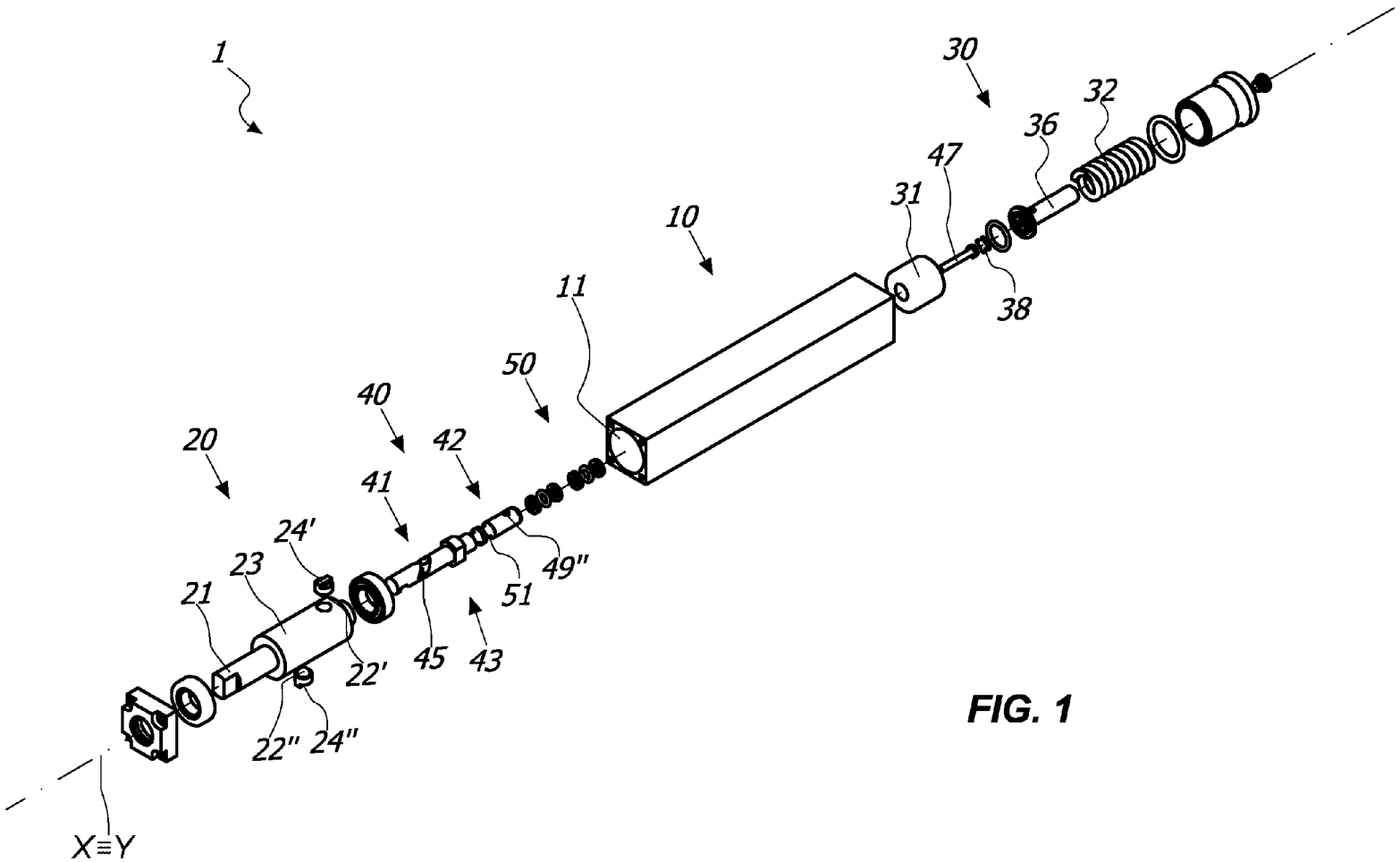
FIG. 1 is an exploded view of a first embodiment of the hinge 1 according to the invention.
Figures 4A, 4B:
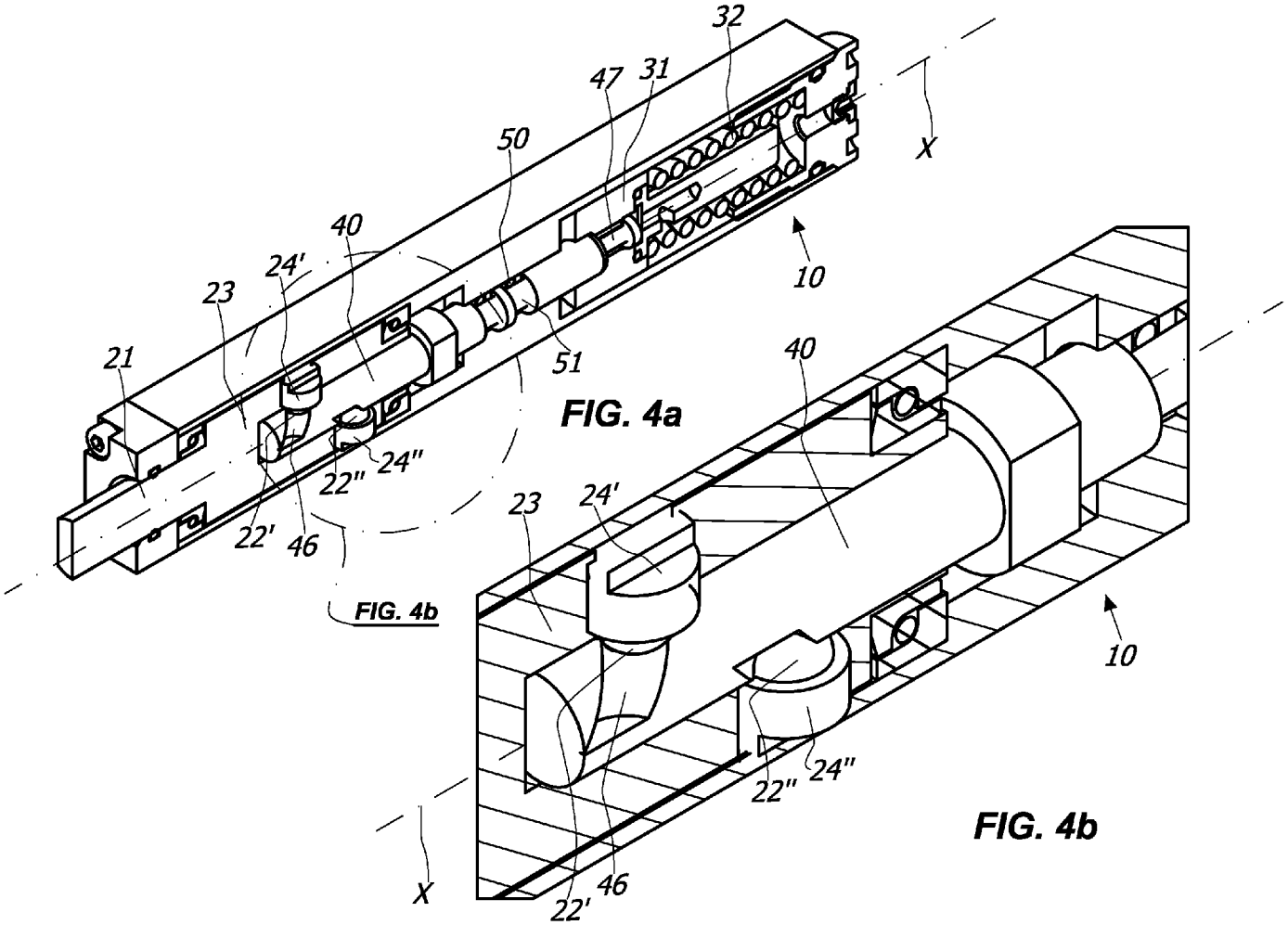
FIG. 4*a* is an axonometric axially sectioned view of the hinge 1 according to the invention, with in FIG. 4*b* some enlarged particulars.
Figure 5:
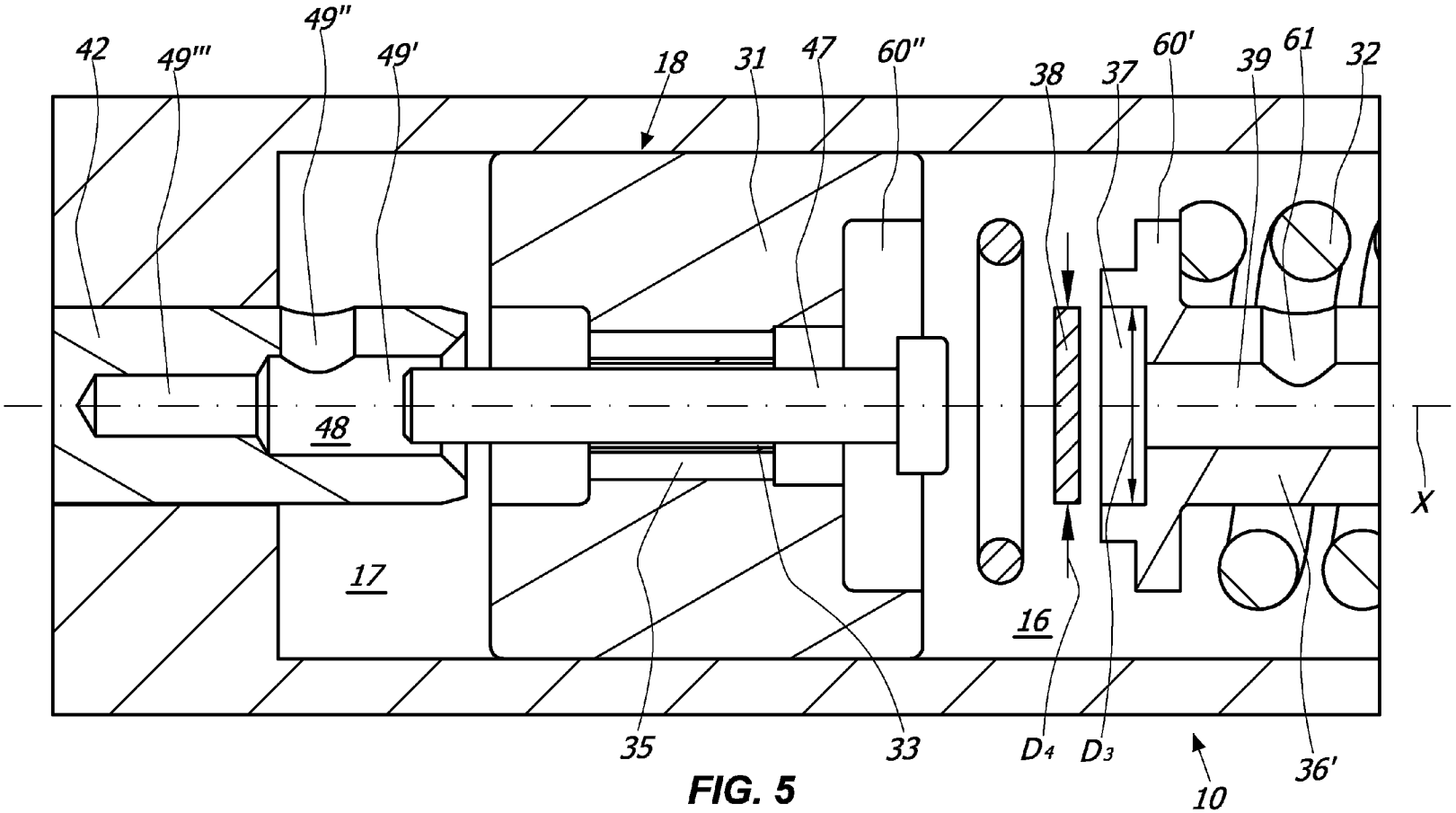
FIG. 5 is an exploded axially sectioned view of some particulars of the hinge 1 according to the invention.

Conveniently, as particularly shown in FIG. 5, the bolt 47 may be inserted into a first hole 33 passing through the cylindrical body 31, whereas the second end portion 42 of the shaft 40 may include a second blind hole 48 at least partly internally threaded to engage the bolt 47.

Thanks to this embodiment, a very simple assembly of the shaft 40 and the plunger element 30 is achieved. Moreover, this embodiment allows minimizing the bulkiness of the hinge, as better explained hereinafter.

Advantageously, a working fluid may be provided, such as oil, acting on the plunger member 30 to hydraulically damp the action thereof.

The operating chamber 11 may comprise a first compartment 13 for housing the plunger member 30 and the oil, and a second compartment 14 for housing the cam element 45 and the at least one follower 22.

Suitably, separation means 50 may be provided to fluidically separate the first compartment 13 from the second one 14, that is the compartment containing the hydraulic damping means and the one containing mechanical actuating means of the hinge.

Thanks to this feature, a very cost-effective hinge 1 can be provided.

The separation means may comprise a separation portion 15 of the operating chamber 11 which is interposed between the first and the second compartments 13, 14. Preferably, the separation portion 15 may have a diameter Dj substantially matching the diameter D2 of the shaft 40.

In the first embodiment of the invention shown in FIGS. 1 to 8*a*, the separation means 50 may comprise one or more sealing rings inserted into suitable seats 51 of the shaft 40 to cooperate with the separation portion 15, while in the second embodiment shown in FIGS. 9 and 10 the separation means 50 may comprise at least one oil seal.

In this manner, any leakage of working fluid from the first compartment 13 into the second one 14 can be avoided.

Advantageously, the cylindrical body 31 may separate the first compartment 13 into a first and a second variable volume adjacent and fluidically connected receptacles 16, 17, the spring 32 being preferably located into the first one 16.

Suitably, the first and second receptacles 16, 17 may be designed to have in correspondence with the closed door position respectively the maximum and minimum volume.

The first compartment 13 may comprise valve means to allow the flow of the working fluid from the first receptacle 16 to the second receptacle 17 upon the opening of the door and to avoid the backflow thereof upon the closing of the door.

In order to allow the controlled backflow of the working fluid from the second receptacle 17 to the first one 16, in the first embodiment of the invention shown in FIGS. 1 to 8*a* the cylindrical body 31 may be inserted into the chamber 11 with a predetermined clearance, which can be in the order of few tenths of millimeters, such to define a tubular interspace 18 between the outer surface 34 the cylindrical body 31 and the inner surface 19 of the operating chamber 11.

In this manner, upon the closing of the door the working fluid will pass through the tubular interspace 18, thus returning from the second receptacle 17 to the first one 16.

On the other hand, in the second embodiment of the invention shown in FIGS. 9 and 10 the cylindrical body 31 may tightly housed into the first compartment 13, so that the passage of the working fluid between the first and the second receptacles 16, 17 is provided within said cylindrical body 31 through the groove 18', according to the teachings of Italian patent application VI2011A000297 which is referred to for proper consultation.

Suitably, the cylindrical body 31 may comprise a third axially passing through hole 35, which may coaxially encompass the first passing-though hole 33. Thanks to this feature, the third passing-through hole 35 may put into fluidic communication the first compartment 16 and the second blind hole 48.

Conveniently, the latter may have a first enlarged portion 49' designed to allow the passage of the working fluid into the second receptacle 17 via a radial outlet 49" and a second portion 49"' which is threaded for engaging the connecting bolt 47.

The valve means may comprise an elongated cylindrical cap member 36 designed to cooperate with the cylindrical body 31 for defining the seat 37 of a butterfly valve 38 slidably moving along the axis X.

To this end, the cylindrical cap member 36 may include an enlarged end portion 60' designed to match with a recess 60" of the cylindrical body 31, in such a manner to define the seat 37.

In order to allow exclusively the sliding movement along the axis X of the butterfly valve 38 into the seat 37, the diameter D3 of the latter may substantially match the diameter D4 of the former.

The cylindrical cap member 36, which may move unitary with the spring 32 and the cylindrical body 31, may include an elongated portion 36' having a fourth passing-through hole 39, with a radial inlet 61.

Thanks to these features, a very easy assembly of the hinge 1 is possible, while extremely minimizing bulk thereof.

In fact, upon the opening of the door, the working fluid will flow through the fourth passing-through hole 39 to selectively open the butterfly valve 38, as shown in FIG. 3*a*, thus allowing the passage of the fluid from the first receptacle 16 to the second one 17 via the third passing-though hole 35 and the enlarged portion 49' and the outlet 49" of the second blind hole 48.

On the other hand, upon the closing of the door, the butterfly valve 38 will selectively close, as shown in FIG. 2*a*, so that the working fluid will be forced to pass through the interspace 18 or the groove 18' to flow back to the first receptacle 16.

Therefore, it is possible to effectively hydraulically damp the automatic closing of the door with a minimum bulkiness, since the hydraulic circuit needed to exploit the damping action has minimum dimensions.

The above construction also ensures a safe, quick and simple assembly of the plunger 30, the shaft 40 and the valve means. In fact, the butterfly valve 38 is in a removable coupling relationship with the cylindrical body 31 such that the bolt 47 is selectively accessible by a user for the mutual fastening/unfastening of the shaft 40 and the cylindrical body 31 only when the fluid control member 38 is decoupled from the cylindrical body 31, i.e. when the cap member 36 is removed from the latter.

The above disclosure clearly shows that the invention fulfils the intended objects.

The invention is susceptible to many changes and variants, all falling within the inventive concept expressed in the annexed claims. All particulars may be replaced by other technically equivalent elements, and the materials may be different according to the needs, without exceeding the scope of the invention defined by the appended claims.

The invention claimed is:

1. A hinge for mutually and rotatably coupling a closing element and a stationary support structure, the hinge comprising:

a hinge body (10) anchorable to one of the stationary support structure or the closing element, said hinge body (10) comprising an operating chamber (11) defining a first longitudinal axis (X);

a pivot (20) anchorable to the other one of the stationary support structure or the closing element, said pivot (20) and said hinge body (10) being rotatably coupled to each other in such a manner to rotate the closing element around a second longitudinal axis (Y) between an open position and a closed position;

a plunger member (30) slidably movable in said operating chamber (11) along said first axis (X) between a compressed end position and an extended end position, said plunger member (30) comprising a substantially cylindrical body (31) housed in said operating chamber (11) for separation thereof into at least a first and a second variable volume receptacle (16, 17) fluidically connected to each other;

a working fluid within said operating chamber (11) to hydraulically damp an action of said plunger member (30);

a valve including a fluid control member (38) movable into a respective valve seat (37) unitary with said cylindrical body (31) to selectively allow a flow of the working fluid between said first receptacle (16) and said second receptacle (17) upon opening or closing of the closing element and to avoid a backflow thereof upon closing or opening of the closing element; and a shaft (40) within said operating chamber (11) defining said first axis (X) for operatively coupling said plunger member (30) and said pivot (20), said shaft (40) and said pivot (20) being rotatably coupled to each other such that a rotation of the closing element around said second axis (Y) corresponds to a sliding of said plunger member (30) along said first axis (X) and the sliding of said plunger member (30) corresponds to the rotation of said closing element, said cylindrical body (31) and said shaft (40) being mutually fastened by a fastening element (47) inserted into a first hole (33) passing through said cylindrical body (31) to engage a second blind hole (48) aligned along a same longitudinal axis with the first hole (33), said second hole being made on an end (42) of said shaft (40);

wherein said second blind hole (48) includes a first enlarged portion (49') for engaging said fastening element (47) and a second portion (49") in fluid communication with said second receptacle (17), said cylindrical body (31) comprising a third passing through hole (35) that puts into fluidic communication said first receptacle (16) and said second receptacle (17) via said valve seat (37) and said first enlarged portion (49'); and wherein said fluid control member (38) is in a removable coupling relationship with said cylindrical body (31) such that the fastening element (47) is selectively accessible by a user for mutually fastening and unfastening the shaft (40) and the cylindrical body (31) only when the fluid control member (38) is decoupled from the cylindrical body (31), said cylindrical body (31) including a recess (60"), the hinge further including a cap member (36) configured to be removably coupled to said cylindrical body (31) and having an enlarged end portion (60') designed to cooperate with said recess (60") of said cylindrical body (31), said enlarged end portion (60') having a cavity defining said valve seat (37) for said fluid control member (38).

2. The hinge according to claim 1, wherein said cap member (36) includes a fourth passing-through hole (39) to put into fluidic communication said operating chamber (11) and said valve seat (37).

3. The hinge according to claim 1, wherein said first and the second variable volume receptacles (16, 17) are reciprocally adjacent.

4. The hinge according to claim 1, wherein the first hole (33), the second blind hole (48) and the valve seat (37) are longitudinally aligned along the first axis (X).

5. The hinge according to claim 1, wherein said third passing through hole (35) parallel to said first hole (33).

6. The hinge according to claim 1, wherein said operating chamber (11) comprises a first compartment (13) for housing said plunger member (30) and said working fluid and a second compartment (14) for housing said pivot (20), a separation element (15, 50) being provided to fluidically separate said first compartment (13) and said second compartment (14), said cylindrical body (31) being located in said first compartment (13) and separating said first compartment into said first and second receptacles (16, 17).

7. The hinge according to claim 6, wherein said separation element (15, 50) is interposed between said first and second compartments (13, 14), said separation element (15, 50) including at least one sealing member (50) coupled thereon to avoid any leakage of working fluid from said first compartment (13) into said second compartment (14).

8. The hinge according to claim 1, wherein said shaft (40) is rotatably blocked in said operating chamber (11) to avoid any rotation around said first axis (X) during sliding of said plunger member (30) between said compressed and extended end positions.

9. The hinge according to claim 2, further comprising an elastic element (32) acting on said plunger member (30) for sliding thereof between said compressed and extended end positions.

10. The hinge according to claim 9, wherein said elastic element (32) is placed into said first variable volume receptacle (16).

11. The hinge according to claim 10, wherein said cap member (36) includes an elongated portion (36') designed to cooperate with said elastic element (32), said fourth passing-through hole (39) being made on said elongated portion (36').

12. The hinge according to claim 6, further comprising a hydraulic circuit (18, 18') to allow the backflow of the working fluid between the closing or opening of the closing element.

13. The hinge according to the claim 12, wherein said valve (36, 37, 38) is designed to allow the flow of the working fluid from said first receptacle (16) to said second receptacle (17) upon the opening of the closing element and to avoid the backflow thereof upon the closing of the closing element.

14. The hinge according to the claim 12, wherein said cylindrical body (31) is housed with a predetermined clearance into said first compartment (13) such that a tubular interspace (18) between an outer surface (34) of said cylindrical body (31) and an inner surface (19) of said first compartment (13) defines said hydraulic circuit (18) for allowing passage of the working fluid between said first and second receptacles (16, 17).

15. The hinge according to the claim 12, wherein said cylindrical body (31) is tightly housed into said first compartment (13), said hydraulic circuit (18') for allowing passage of the working fluid between said first and second receptacles (16, 17) being provided within said cylindrical body (31).

16. The hinge according to claim 15, wherein said cylindrical body (31) includes a peripheral groove (18') defining said hydraulic circuit.

17. The hinge according to claim 1, wherein one of said shaft (40) or said pivot (20) comprises a cam element (45) configured to be engaged by a follower member (22', 22") provided on the other one of said pivot (20) or said shaft.

18. The hinge according to claim 1, wherein said first axis (X) and said second axis (Y) are substantially orthogonal to each other.

19. The hinge according to claim 1, wherein said first axis (X) and said second axis (Y) are substantially coincident with each other.

20. The hinge according to the claim 17, wherein said cam element (45) comprises at least one groove (46) having a helical shape defined on said shaft (40).

21. The hinge according to claim 20, wherein said at least one groove (46) has a semispherical section, said follower member including one couple of corresponding counter-shaped semispherical followers (22', 22") unitary with said pivot (20) and laying on opposite sides of said shaft (40), and wherein each of said semispherical followers (22', 22") is configured to be reciprocally engaged with a respective V-shaped helical groove (46).

22. The hinge according to the claim 21, wherein said semispherical followers (22', 22") are disposed in longitudinally offset positions.

* * * * *